US007076939B2

(12) United States Patent
Schwartz

(10) Patent No.: US 7,076,939 B2
(45) Date of Patent: Jul. 18, 2006

(54) METHOD OF MAKING FURNITURE WITH SYNTHETIC WOVEN MATERIAL

(75) Inventor: Larry Schwartz, Franklin Lakes, NJ (US)

(73) Assignee: Sun Isle USA, LLC, Boca Raton, FL (US)

( * ) Notice: Subject to any disclaimer, the term of this patent is extended or adjusted under 35 U.S.C. 154(b) by 43 days.

(21) Appl. No.: 10/290,638

(22) Filed: Nov. 8, 2002

(65) Prior Publication Data

US 2003/0115849 A1 Jun. 26, 2003

Related U.S. Application Data

(63) Continuation-in-part of application No. 10/123,943, filed on Apr. 17, 2002, which is a continuation-in-part of application No. 10/073,634, filed on Feb. 11, 2002, now Pat. No. 6,705,070, which is a continuation-in-part of application No. 10/062,905, filed on Jan. 31, 2002, now Pat. No. 6,625,970.

(60) Provisional application No. 60/336,819, filed on Dec. 5, 2001.

(51) Int. Cl.
*D02G 3/02* (2006.01)

(52) U.S. Cl. ..... 57/238

(58) Field of Classification Search ..... 57/238
See application file for complete search history.

(56) References Cited

U.S. PATENT DOCUMENTS

| | | | | |
|---|---|---|---|---|
| 2,321,746 | A | 6/1943 | Heymann | |
| 3,101,522 | A * | 8/1963 | Hooper et al. | 28/159 |
| 3,353,346 | A * | 11/1967 | Laureti | 57/237 |
| 3,488,934 | A | 1/1970 | MacDonald | |
| 3,559,390 | A | 2/1971 | Staschewski | |
| 3,792,899 | A | 2/1974 | Rocchia et al. | |
| 3,867,967 | A | 2/1975 | Rochhia et al. | |
| 3,948,702 | A | 4/1976 | Theissen | |
| 4,155,394 | A * | 5/1979 | Shepherd et al. | 152/527 |
| 4,168,606 | A | 9/1979 | Callander | |
| 4,231,834 | A | 11/1980 | Trejo Gonzalez | |
| 4,246,747 | A | 1/1981 | Plunkett et al. | |
| 4,289,564 | A | 9/1981 | Hanaford et al. | |
| 4,295,235 | A | 10/1981 | Dietz | |
| 4,395,029 | A | 7/1983 | Davis et al. | |
| 4,467,839 | A | 8/1984 | Westhead | |
| 4,469,738 | A | 9/1984 | Himelreich, Jr. | |
| 4,586,751 | A | 5/1986 | McGuire | |
| 4,696,830 | A * | 9/1987 | Obayashi et al. | 427/491 |
| 4,744,935 | A | 5/1988 | Priaroggia et al. | |
| 5,084,221 | A | 1/1992 | Matsuno et al. | |

(Continued)

FOREIGN PATENT DOCUMENTS

DE 19516174 11/1996

(Continued)

OTHER PUBLICATIONS

Kathryn L. Hatch, Textile Science, 1993 West Publishing Co., 1st Edition, pp. 119-120.

(Continued)

*Primary Examiner*—Shaun R Hurley
(74) *Attorney, Agent, or Firm*—Lerner, David, Littenberg, Krumholz & Mentlik, LLP

(57) ABSTRACT

An article of furniture is made from elongated polymer filaments. The polymer filaments may be monofilaments or plural filaments which are twisted together and heat set to prevent their untwisting during the subsequent weaving process. The heat setting of the polymer filaments is achieved by heating the polymer material either before or after the twisting process.

16 Claims, 7 Drawing Sheets

U.S. PATENT DOCUMENTS

| | | | | |
|---|---|---|---|---|
| 5,200,261 | A | 4/1993 | Taguchi et al. | |
| 5,284,380 | A | 2/1994 | Gehry | |
| 5,507,997 | A | 4/1996 | Evain | |
| 5,625,976 | A * | 5/1997 | Goodale | 43/44.98 |
| 5,700,490 | A | 12/1997 | Meise | |
| 5,704,690 | A | 1/1998 | Schwartz | |
| D395,171 | S | 6/1998 | Schwartz | |
| 5,807,794 | A * | 9/1998 | Knox et al. | 442/306 |
| 5,845,970 | A | 12/1998 | Schwartz | |
| 5,858,885 | A | 1/1999 | Hamilton et al. | |
| D409,001 | S | 5/1999 | Schwartz | |
| 6,007,911 | A | 12/1999 | Bowen, Jr. | |
| 6,035,901 | A | 3/2000 | Stumpf et al. | |
| 6,074,751 | A | 6/2000 | Murakami et al. | |
| 6,117,548 | A | 9/2000 | Swers et al. | |
| 6,120,097 | A | 9/2000 | Perry et al. | |
| 6,179,382 | B1 | 1/2001 | Schwartz | |
| 6,244,031 | B1 | 6/2001 | Murakami et al. | |
| 6,264,674 | B1 | 7/2001 | Washington et al. | |
| 6,601,378 | B1 * | 8/2003 | Fritsch et al. | 57/238 |
| 2002/0144497 | A1 | 10/2002 | Scheunemann | |

FOREIGN PATENT DOCUMENTS

| | | |
|---|---|---|
| EA | 03732311 | 6/1990 |
| EP | 0210710 | 2/1987 |
| GB | 1047156 | 11/1980 |
| JP | 57133212 | 8/1982 |
| JP | 58098437 A | 6/1983 |
| JP | 11179705 | 7/1999 |
| WO | WO 138629 A1 | 5/2001 |

OTHER PUBLICATIONS

Steven B. Warner, Fiber Science, 1995 Prentice-Hll, Inc., 1st Edition, p. 237.

* cited by examiner

METHOD OF MAKING FURNITURE WITH SYNTHETIC WOVEN MATERIAL

CROSS REFERENCE TO RELATED APPLICATIONS

The present application is a continuation-in-part of co-pending U.S. patent application Ser. No. 10/123,943, filed Apr. 17, 2002, which is a continuation-in-part of U.S. patent application Ser. No. 10/073,634, filed Feb. 11, 2002 now U.S. Pat. No. 6,705,070, which is a continuation-in-part of U.S. patent application Ser. No. 10/062,905, filed Jan. 31, 2002 now U.S. Pat. No. 6,625,970, entitled "Method of Making Furniture With Synthetic Woven Material" which claims the benefit of U.S. Provisional Application No. 60/336,819, filed Dec. 5, 2001, the disclosures of which are hereby incorporated by reference herein.

BACKGROUND OF THE INVENTION

The present invention relates in general to the field of furniture constructed with synthetic woven material, and more particularly, to methods of stabilizing synthetic yarns of multiple filaments such as twisted yarns and woven synthetic yarn material using heat treatment during the manufacturing process.

Natural wicker has been used in the manufacture of furniture, baskets and other articles for many centuries. Natural wicker articles are manufactured from the twigs or branches of various plants that are first soaked in water in order to make them pliable, then woven to form into the article and finally allowed to dry. Furniture manufactured from wicker offers greater comfort than furniture manufactured from some other materials because of wicker's inherent compliancy. Further, wicker is light weight and reasonably strong, making it an important material in the manufacture of furniture.

The popularity of wicker furniture has increased significantly. The casual, informal appearance of wicker has made it especially popular for use in enclosed porches and other informal settings in homes, hotels and other establishments. Natural wicker, however, has had limited use in the outdoor furniture market, including patio furniture, pool furniture and the like. This is because natural wicker softens and weakens when wet, and is more susceptible to rotting and mildew than many other natural and man-made furniture materials.

Woven wicker typically comprises a warp yam, i.e., a yam running straight through the woven material and providing support, and a weft yam, i.e., a yam used as filler that is woven around the warp yam. Numerous styles of weave are used in the manufacture of wicker furniture. The various styles of weave result in a different look, feel, strength and weight of the finished woven product. In a simple weave pattern, the warp yams are spaced apart and arranged parallel to each other. The weft yams are woven over and under alternating warp yams. Adjacent weft yams pass on opposite sides of a given warp yarn. Variations of this pattern, such as passing the weft yam over two adjacent warp yarns, are known in the art.

Polymer yams have also been used to manufacture wicker-like furniture. By way of example, a polymer yam is known which is constructed as an elongated body, such as of indeterminate length, having a core surrounded by a polyvinylchloride (PVC) outer coating, for example, foamed PVC material which gives greater volume with less material. The outer coating may be formed of other synthetic materials such as polyamides, polyesters and the like. The yam is typically made in a single step using a coextrusion process, as is known in the art. The inner core may include a single filament of polyester, or may include a plurality of polyester filaments bundled to form a single core. In addition, the core may be formed of other materials than polyester, monofilament or stranded, such as polyamides and the like. The core is designed to give the yam greater mechanical strength over yams formed only of polymer material.

The polymer yam being constructed from foamed PVC material results in a lack of uniformity in the foaming of the PVC material during the extrusion process. This produces a yarn which lacks a uniform cylindrical appearance. Specifically, the outer surface of the yam is deformed, such as by having undulations, mounds and/or depressed areas along the length of the yam. The deformed shape of the outer surface of the yam results in the yarn having a more natural look to that of real wicker. It is also known to provide the exterior surface of the polymer yam with one or more random stripes of a contrasting color and/or one or more random grooves. The stripes and grooves can be continuous and/or intermittent along the exterior surface of the yarn. The yam, however, can also have a more uniform cylindrical shape, as well as other shapes such as square, oval, triangular and the like. Polymer yarns as thus far described are known from U.S. Pat. Nos. 5,704,690; 5,845,970; and 6,179,382, as well as U.S. Design Pat. Nos. 395,171; and 409,001, the disclosures of which are incorporated herein by reference.

As in the case of natural wicker, polymer yams have been woven into a woven material which has been used in the manufacture of casual furniture suitable for the outdoor furniture market, including patio furniture, as well as for indoor use. Due to the nature of polymer yarns, it has been known to subject the woven material to a heat setting process prior to attaching the woven material to the frame forming the finished article of furniture. In this regard, a section of the woven material would be placed in an oven at an elevated temperature to cause the polymer material to soften whereby contiguous portions of the yarn would bond together stabilizing the shape of the woven material. The heat set woven material would be subsequently attached to the skeletal frame of an article of furniture to form, for example, a seat portion, a back rest portion or the like.

Heat setting the woven material renders the material less flexible, and therefore, more difficult to conform and attach to the skeletal frame of an article of furniture. In addition, certain components of the furniture article are only wrapped with a continuous strand of polymer yarn without forming a weave. As this wrapped portion is not subject to a heat setting process, it is possible that the wrapping will loosen during use of the furniture article.

It is therefore desirable to provide improvements in the manufacture of furniture articles including the use of polymer yams and woven material therefrom, and more particularly, to a heat setting process which overcomes the disadvantages noted with respect to the aforementioned furniture articles.

SUMMARY OF THE INVENTION

In accordance with one embodiment of the invention there is described a twisted elongated yam comprising an elongated first yam of polymer material twisted together with an elongated second yarn forming a composite yarn having a twisted shape, wherein one of the first and second yams is different from the other one of the first and second yams in at least one of size, shape, surface configuration and surface appearance.

In accordance with another embodiment of the invention there is described a twisted elongated yam comprising an elongated first yam, an elongated second yarn and an elongated third yam, the first, second and third yarns twisted together to form a composite twisted yam, wherein at least one of the yarns comprises polymer material, and wherein one of the first, second and third yams is different from at least one of the other two yams in at least one of size, shape, surface configuration and surface appearance.

In accordance with another embodiment of the invention there is described an article of furniture comprising a frame having a shape of an article of furniture and at least one panel attached thereto formed as a weave from a plurality of elongated members, at least one of the members comprising an elongated first yam of polymer material twisted together with an elongated second yarn forming a composite yarn having a twisted shape, wherein one of the first and second yarns is different from the other one of the first and second yarns in at least one of size, shape, surface configuration and surface appearance.

In accordance with another embodiment of the invention there is described an article of furniture comprising a frame having a shape of an article of furniture and at least one panel attached thereto formed as a weave from a plurality of elongated members, at least one of the member comprising an elongated first yarn, an elongated second yam and an elongated third yarn, the first, second and third yams twisted together to form a composite twisted yam, wherein at least one of the yarns comprises polymer material, and wherein one of the first, second and third yams is different from at least one of the other two yarns in at least one of size, shape, surface configuration and surface appearance.

BRIEF DESCRIPTION OF THE DRAWINGS

The above description, as well as further objects, features and advantages of the present invention will be more fully understood with reference to the following detailed description of a method of making furniture with synthetic woven material, when taken in conjunction with the accompanying drawings, wherein.

DETAILED DESCRIPTION

In describing the preferred embodiments of the subject matter illustrated and to be described with respect to the drawings, specific terminology will be resorted to for the sake of clarity. However, the invention is not intended to be limited to the specific terms so selected, and is to be understood that each specific term includes all technical equivalence which operate in a similar manner to accomplish a similar purpose.

In describing the preferred embodiments of the subject matter illustrated and to be described with respect to the drawings, specific terminology will be resorted to for the sake of clarity. However, the invention is not intended to be limited to the specific terms so selected, and is to be understood that each specific term includes all technical equivalence which operate in a similar manner to accomplish a similar purpose.

Figure 1:
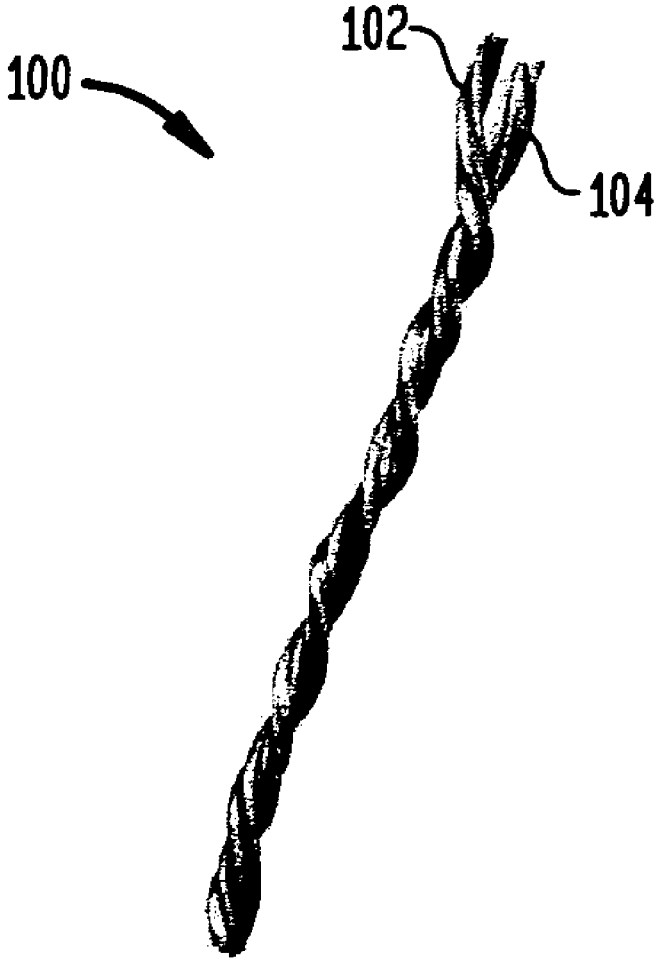
FIG. 1 is top plan view of a portion of a heat set twisted polymer yarn constructed in accordance with one embodiment of the present invention.
Figure 7:
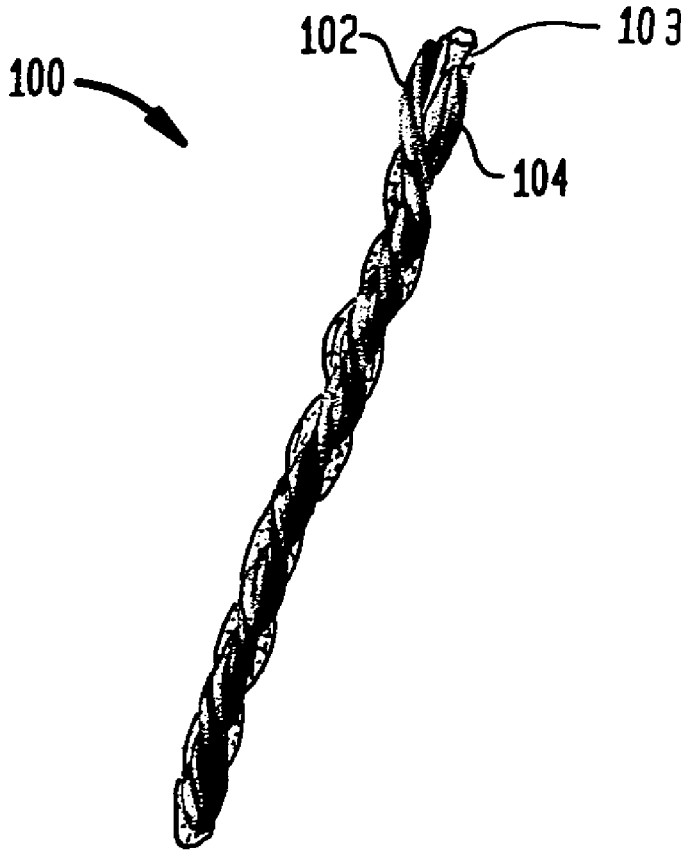
FIG. 7 is top plan view of a portion of a heat set twisted polymer yarn constructed in accordance with one embodiment of the present invention.

Referring to the drawings, wherein like reference numerals represent like elements, there is shown in FIG. 1 in accordance with one embodiment of the present invention a twisted yarn of indeterminate length designated generally by reference numeral 100 which has been heat set in accordance with the present invention. The twisted yarn 100 is made of two strands or filaments 102, 104 of polymer material of the type and construction as described in the aforementioned patents which have been incorporated herein by reference. However, other strands or filaments of polymer material of a different construction or polymer material are also contemplated for use in producing a twisted yarn 100 or a weave of woven material in accordance with the present invention. Although the twisted yarn 100 has been illustrated as comprising two strands 102, 104, it is to be understood that the twisted yarn can be constructed from greater than two strands if so desired, e.g., three or more strands 102, 103, 104 such as shown in FIG. 7. In addition, it is not required that the strands 102, 104 be identical in size, shape, surface appearance (e.g., coloration) and/or surface configuration. For example, a twisted elongated yarn can be constructed from an elongated first yarn of polymer material twisted together with an elongated second yarn forming a composite yarn having a twisted shape. One of the first and second yarns is different from the other one of the first and second yarns in at least one of size, shape, surface configuration and surface appearance. The second elongated yarn may also be polymer material.

Further, the twisted yarn may include an elongated third yarn twisted together with the first and second yarns, or any other number of additional yarns. The third yarn may be polymer material. The third yarn may be substantially similar to one of the first and second yarns in at least one of size, shape, surface configuration and surface appearance. The third yarn may also be different from the first and second yarns in at least one of size, shape, surface configuration and surface appearance. Further, one of the first and second yarns may be different from the other one of the first and second yarns in all of size, shape, surface configuration and surface appearance.

By way of further example, the twisted elongated yarn can be constructed from an elongated first yarn, an elongated second yarn and an elongated third yarn. The first, second and third yarns are twisted together to form a composite twisted yarn, wherein at least one of the yarns is polymer material. One of the first, second and third yarns is preferably different from at least one of the other two yams in at least one of size, shape, surface configuration and surface appearance. The first, second and third yarns may all be polymer material. Each of the first, second and third yarns may be different from each other in at least one of size, shape, surface configuration and surface appearance. Each of the first, second and third yarns may also be different from each other in size, shape, surface configuration and surface appearance. One of the first, second and third yarns may be a natural material, e.g., cotton.

In accordance with the above embodiments, an article of furniture can constructed from a frame having a shape of an article of furniture and at least one panel attached thereto formed as a weave from a plurality of elongated members. At least one of the members includes an elongated first yarn of polymer material twisted together with an elongated second yarn forming a composite yarn having a twisted shape. One of the first and second yarns is different from the other one of the first and second yarns in at least one of size, shape, surface configuration and surface appearance. The first and second yarns may be constructed as described in accordance with this application.

In accordance with the above embodiments, an article of furniture can be constructed from a frame having a shape of an article of furniture and at least one panel attached thereto formed as a weave from a plurality of elongated members. At least one of the members includes an elongated first yarn, an elongated second yarn and an elongated third yarn. The first, second and third yarns are twisted together to form a composite twisted yarn, wherein at least one of the yarns is polymer material. One of the first, second and third yarns is different from at least one of the other two yarns in at least one of size, shape, surface configuration and surface appearance. The first, second and third yarns may be constructed as described in accordance with this application.

Figure 2:
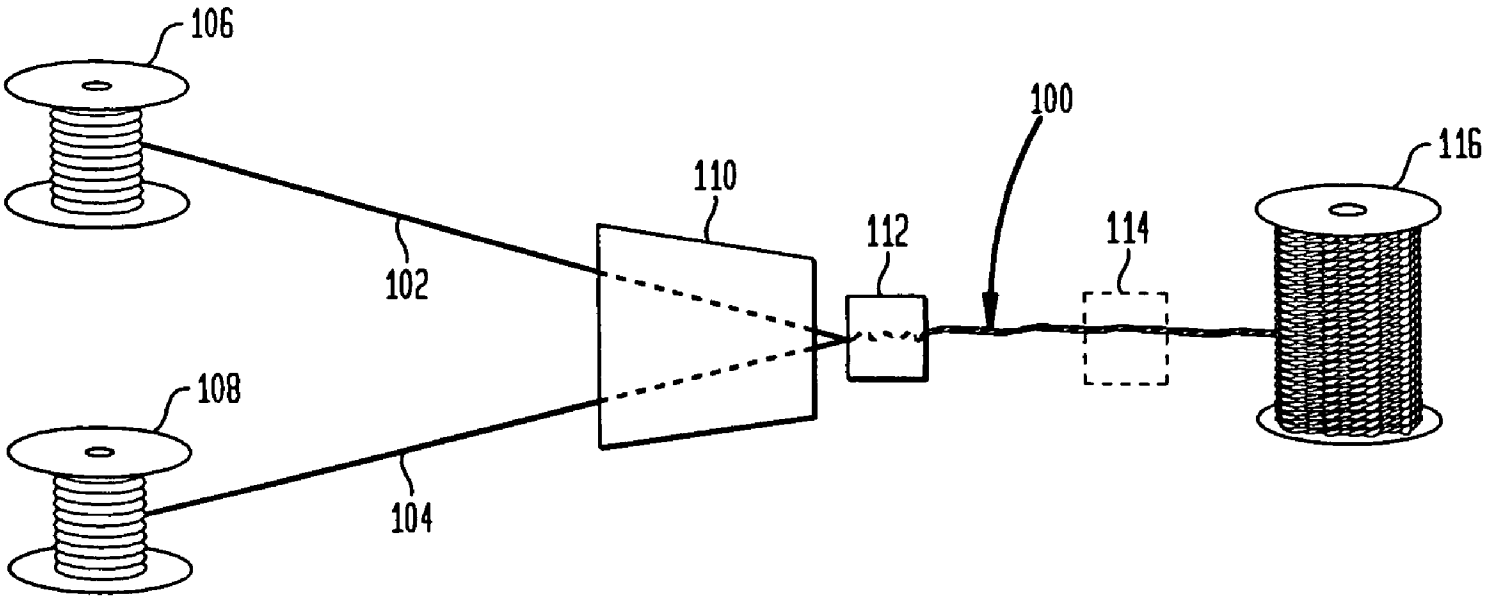
FIG. 2 is a diagrammatic illustration showing the fabrication process of heat setting the twisted polymer yarn as shown in FIG. 1.

Referring now to FIG. 2, there will be described the process of manufacturing a heat set twisted yarn 100 in accordance with one embodiment of the present invention. As shown, there is provided a source 106 of a continuous length of a strand 102 of polymer material. A similar source 108 is provided for a continuous length of another strand 104 of polymer material. Generally, the sources 106, 108 will be in the nature of a spool of an indeterminate length of the strands 102, 104 of the polymer material.

The individual strands 102, 104 are fed concurrently from the spools into an oven 110 which is heated to a predetermined temperature. In the case of PVC material, an oven temperature of about 270° F. has been found suitable for use in accordance with the present invention. The temperature of the oven 110 will take into consideration the type of the polymer material forming the strands 102, 104, as well as the linear rate in which the strands pass through the oven, for example, the residence time in the oven. Based upon the oven temperature and residence time of the strands 102, 104 within the oven 110, at least the outer surface of the strands will reach about their softening temperature. Accordingly, lower temperatures with longer residence times and higher temperatures with shorter residence times are contemplated. It is preferable that the temperature of the strands 102, 104 do not reach their melting temperature where they would lose their general shape. However, a slight melting of the outer surface region of the strands 102, 104 is contemplated within the scope of the present invention. Although the invention has been described as heating both of the strands 102, 104, it is contemplated to adhere the strands together by heating only one of the strands. The other strand may be at room temperature or heated to a temperature less than its softening temperature.

It can be appreciated that the temperature of the oven will vary according to the particular polymer material forming the strands 102, 104, as well as the residence time for the strands within the oven. For polymer material most suitable for use in accordance with the present invention, a temperature range of 200 to 375° F., and more preferably about 250 to 300° F. is contemplated. However, as the basis for determining the oven temperature and residence time have been described herein, it is to be understood that other temperatures can be selected for suitable use with any polymer material in which to form a twisted yarn from strands 102, 104.

As the heated strands 102, 104 exit the oven 110, they pass through a conventional filament twisting apparatus 112. The twisting apparatus 112 is operative for twisting the two strands 102, 104 together to form the twisted yarn 100 as best shown in FIG. 1. The twisting apparatus 112 may be of any suitable construction such as known in the rope art where continuous lengths of filaments are twisted together. During the twisting process, there is a degree of compression between the strands 102, 104 which, due to their heated temperature, results in the strands bonding together to generally form a single integral strand having a twisted configuration as shown in FIG. 1. It is to be understood that it is not a requirement that the strands 102, 104 be integral over their entire length, but rather, have contiguous intermittent portions over their length which are joined together whereby the twisted yarn 100 is prevented from unraveling during the subsequent weaving process.

The twisted yarn 100 is subject to air cooling, or optionally, passed through a cooling device 114. The cooling device 114 may include a source of blowing ambient air, or air chilled to aid in bringing the twisted yarn 100 to room or ambient temperature. The resulting twisted yarn 100 is subsequently wound upon a spool 116. It is also contemplated that the twisting apparatus 112 may be positioned before the oven 110, as well as providing separate ovens 110 for each strand 102, 104 operating at the same or different temperature. Different process conditions are contemplated where the strands 102, 104 are of a different construction, composition or size.

The individual strands 102, 104 may be formed by hot extrusion of polymer material through a die. It is therefore contemplated that the strands 102, 104, while in a heated state after extrusion, may be twisted in the twisting apparatus 112, thereby eliminating the need for a separate oven 110. Depending upon the exit temperature of the strands 102, 104 from the extruder, the strands may be allowed to air cool or provided with a separate cooling device 114 for either or both of the strands prior to twisting.

Figure 3:
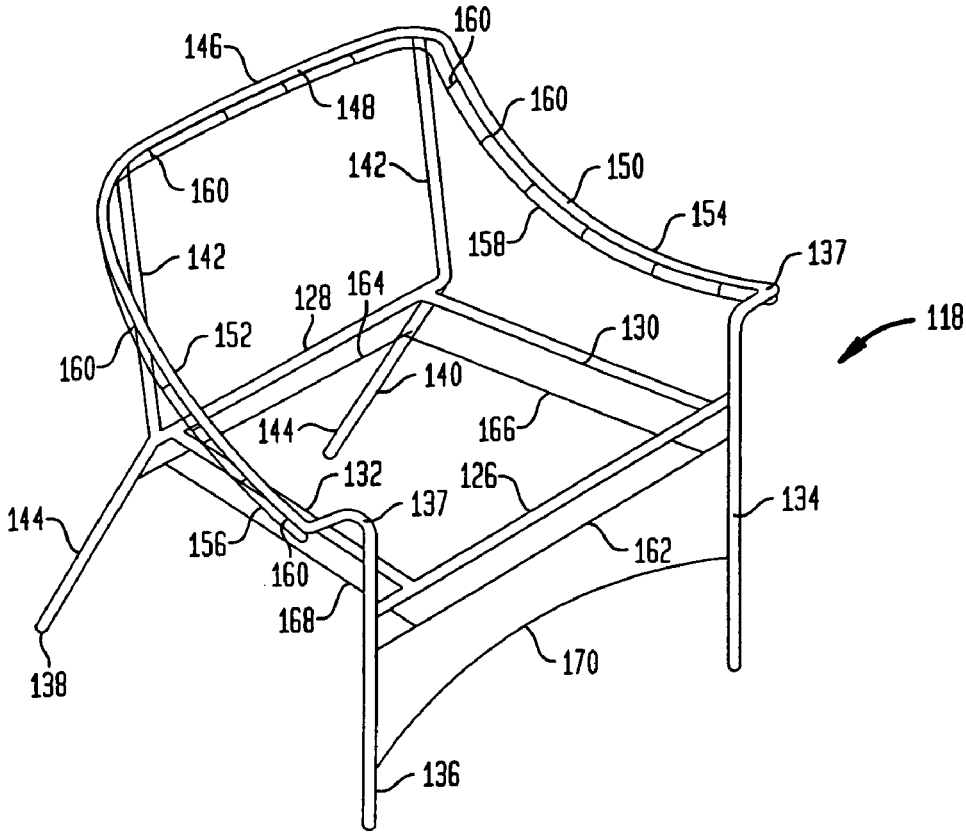
FIG. 3 is a perspective view of a skeletal frame of an article of furniture.
Figure 5:
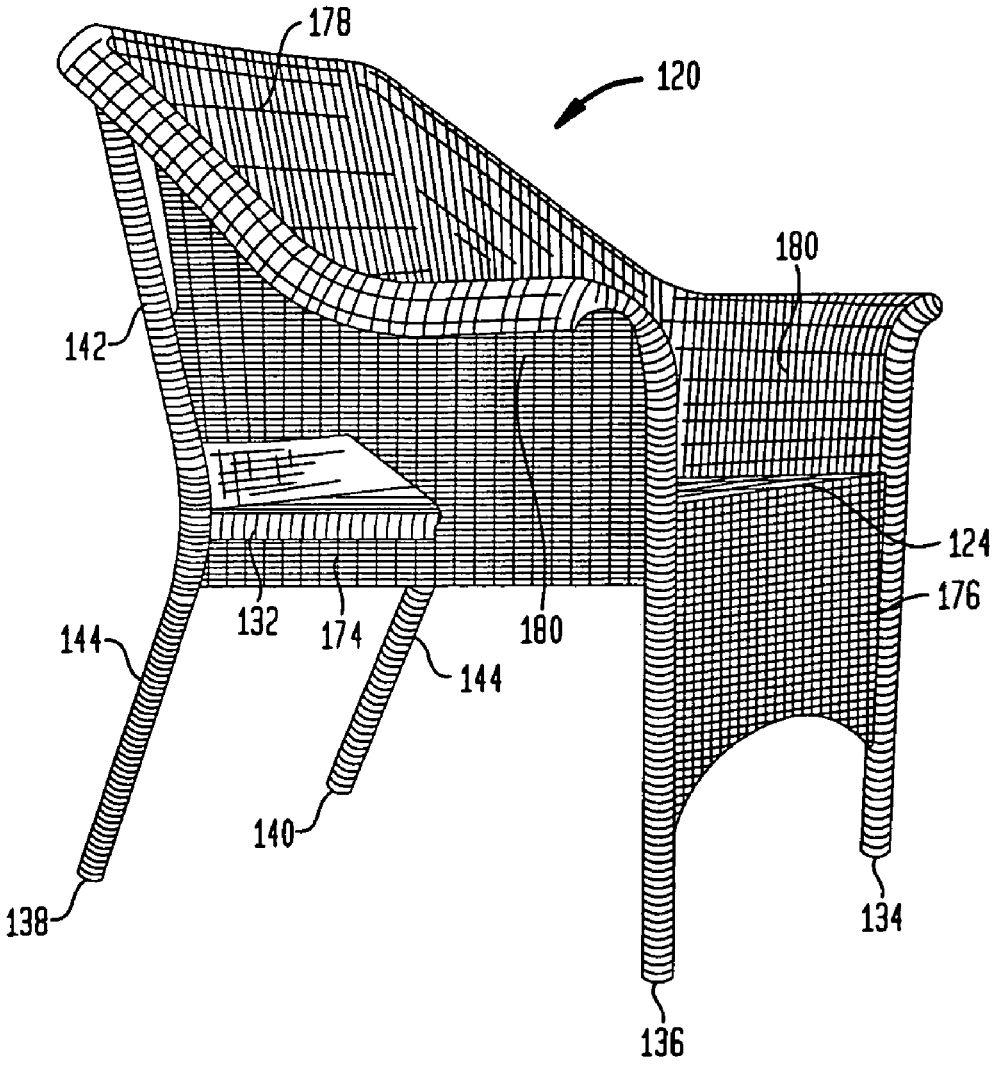
FIG. 5 is a perspective view of an article of furniture in the nature of a chair to which there is attached the woven material as shown in FIG. 4 and components wrapped with the twisted polymer yarn as shown in FIG. 1.

There will now be described one method of using the heat set twisted yarn 100 in constructing an article of furniture such as a chair, by way of one example. It is to be understood that other furniture items such as couches, tables, benches, stools, trunks and the like can also be produced in accordance with the teachings of the present invention. As shown in FIGS. 3 and 5, a chair 120 can be produced from a rigid skeletal frame 118 which will be covered with a weave of woven material produced from the heat set twisted yarn 100.

The frame 118 provides an arm chair with a seat, a back rest, a pair of front legs, a pair of back legs and a pair of side arms. The seat 124 (see FIG. 5) is delineated by a connecting front member 126, a parallel spaced apart back member 128 and a pair of parallel spaced apart side members 130, 132. The front legs 134, 136 are constructed as parallel spaced apart vertical members joined to the free ends of the front member 126 and have outwardly turned extensions 137 providing the front legs with an L-shape. The front legs 134, 136 are arranged generally vertical to the floor as viewed from the front and side of the chair 120.

The back legs 138, 140 are constructed from an angular member attached to the free ends of the back member 128. The back legs 138, 140 have generally parallel spaced apart upper members 142 extending vertically from the back member 128 as viewed from the front and side and generally parallel spaced apart lower members 144. The lower members 144 are arranged at a rearwardly extending angle as viewed from the side and extend generally vertical from the back member 128 as viewed from the rear of the chair 120.

A generally U-shaped member 146 includes a center section 148 connected across the free ends of the upper members 142 of the back legs 138, 140 and a pair of curved spaced apart side arm members 150, 152 forming the side arms 154, 156 of the arm chair. The free ends of the side arm members 150, 152 are attached to the free ends of the extensions 137 of the respective front legs 134, 136. The side arm members 150, 152 are spaced apart wider at their mouth where they connect to the extensions 137 then where they form the center section 148. This arranges the side arms 154, 156 outwardly of the side members 130, 132. The upper members 142 of the back legs 138, 140, the back member 128 and center section 148 delineate the back 178 of the chair 120.

A secondary frame can be used to provide attachment support for the woven material utilized in covering the frame 118. Specifically, a generally U-shaped elongated rod 158 having a shape conforming substantially to the shape of the U-shaped member 146 is connected thereto in underlying relationship by means of a plurality of spaced apart ribs 160. Another secondary support frame is positioned between the front and back legs 134, 136, 138, 140 underlying the seat 124. This secondary frame is constructed from a front rod 162 connected between the front legs 134, 136, a back rod 164 connected between the back legs 138,140 and a pair of side rods 166, 168 arranged in parallel spaced apart relationship connected between the front rod 162 and back rod 164 inwardly of their terminal ends. An additional front rod 170 may be positioned between the front legs 134, 136 underlying front rod 162.

Figure 4:
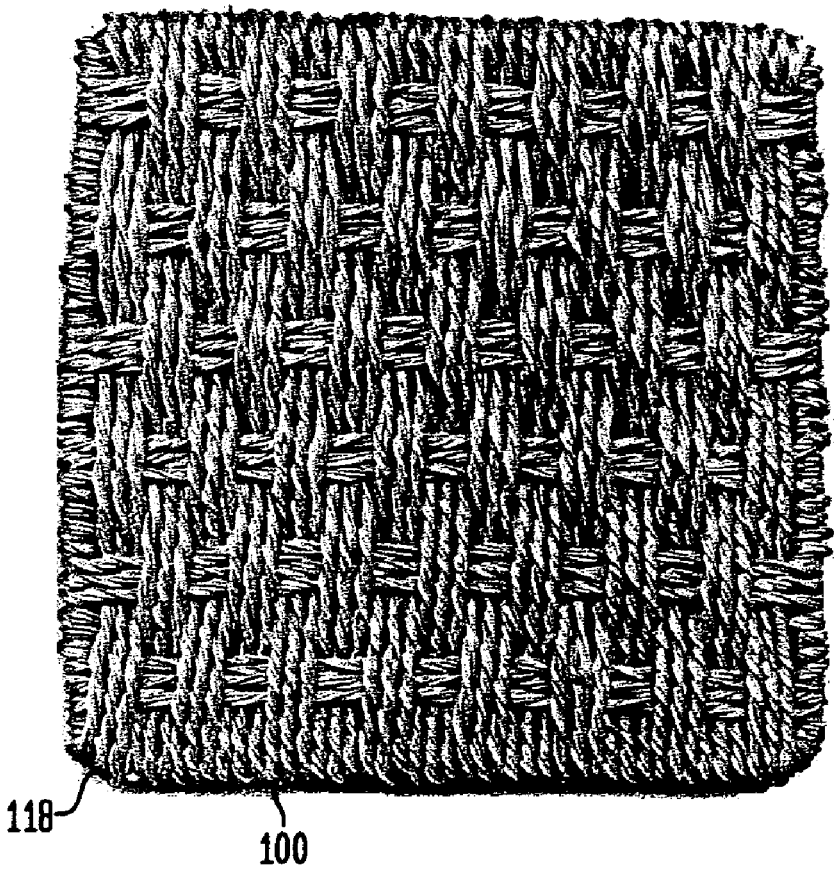
FIG. 4 is a top plan view of woven material constructed by weaving the polymer yarn as shown in FIG. 1 in accordance with one embodiment of the present invention.

Referring now to FIGS. 4 and 5, the frame 118 is covered by weaving the heat set twisted yarn 100 into a woven material to form panels of woven material directly on the frame. A plurality of individual strands of the twisted yarn 100 are attached to various portions of the frame 118, for example, to the secondary frame as previously described. The individual strands of the twisted yarn 100, as they are attached to the frame 118, are directly woven into a predetermined weave pattern, for example, see FIG. 4. As shown in FIG. 4, the weave pattern is a 4×4 pattern of weft and warp strands. However, the pattern may include any number of weft and warp strands of twisted yarn 100, for example, a 2×2, 5×5, 6×6, 10×10, etc. In addition, it is not required that the woven material be symmetrical. In this regard, it is contemplated that the weave may comprise a 2×3, 3×5, 4×7, 2×5, 2×6, etc. weft and warp woven pattern. In addition, the twisted yarn 100 may be woven into integral designs. As such, the resulting panels of woven material, as shown in FIG. 4, are woven in situ directly on the frame 118.

Referring to FIG. 5, there is illustrated a chair 120 which has been fabricated by the in situ weaving of the twisted yam 100 into woven material which is attached to the frame 118. As shown, the chair 120 includes a seat portion 124, a front skirt portion 176, a back rest portion 178 and side portions 180. The front and back legs 134, 136, 138, 140 are wrapped with a continuous length of heat set twisted yarn 100. In this regard, the twisted yarn 100 is wrapped in a compact spiral around the length of each leg without weaving.

Figure 6:
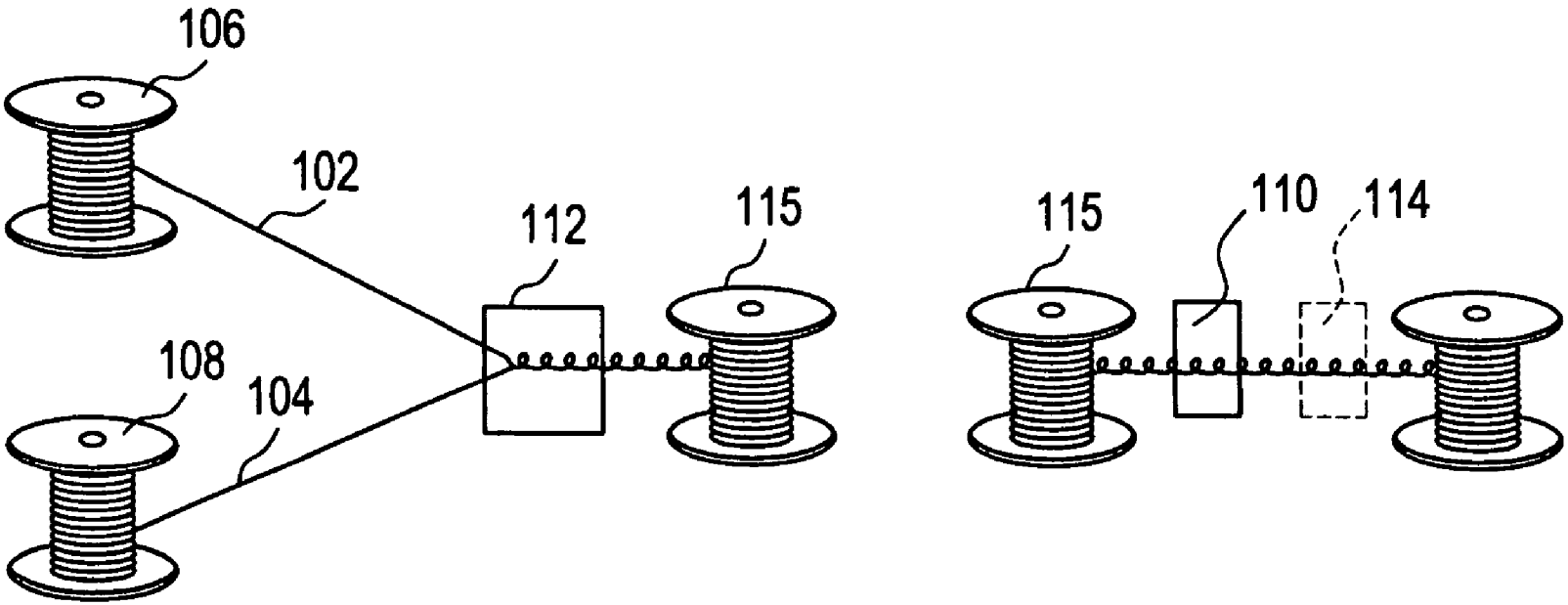
FIG. 6 depicts a process of twisting polymer yarn and heat setting the twisted polymer yarn.

Referring to FIG. 6, there is provided a filament twisting apparatus 112 and an oven 110 for heat setting the twisted yarn.

As shown, polymer strands 102 and 104 are twisted at room temperature by the filament twisting apparatus 112 and the twisted composite yarn is then wound to a spool 115. The twisted composite yarn is then unwound from the spool 115 into the oven 110 for heat setting, preferably below the melting temperature of the yarn, more preferably at a yarn surface temperature of lower than about 260° F., and the most preferably lower than about 250° F. The heat set twisted composite yarn is subject to air-cooling, or optionally, passed through a cooling device 114, and rewound to spool 116.

Although the individual strands of twisted yarn 100 have been heat set, the woven material itself, as well as the twisted yarn 100 wrapped about the front and back legs 134, 136, 138, 140 are not heat set. As a result, the individual strands of twisted yarn 100 can shift within the weave or about the legs during use of the chair 120. Over time, this can detract from the aesthetics of the chair.

In accordance with the present invention, the entire chair 120 is placed into an oven similar to oven 110 in order to heat set the attached woven material and wrapped twisted yarn 100 similar to that used in the production of the heat set twisted yarn. In the case of the chair 120, it is contemplated that the oven will be a batch oven, as opposed to a continuous oven 110 as described with respect to the manufacture of the twisted yarn 100. In this regard, the oven will typically be of sufficient size to hold a plurality of chairs 120. The chairs will remain in the oven at a predetermined temperature for a predetermined residence time to cause the twisted yarn to reach about its softening temperature or above, whereby contiguous portions of the twisted yarn 100 will bond or fuse together within the weave and wrapped portions when the chair is removed from the oven and allowed to cool. The cooling process may take place either within the oven or outside the oven by being subjected to ambient air. In addition, it is also contemplated that a source of chilled air may be blown over the heated chairs 120 either in a confined housing or in an open area.

The temperature and residence time for the oven for heat setting the woven polymer material are similar to those as thus far described with respect to the twisted yarn. In addition, it is contemplated that the woven material can be formed from other than twisted yarn 100. For example, individual filaments, as well as plural filaments which are untwisted can also be used in forming the woven material for adhering to the frame of the article of furniture which is to be ultimately heat set. It is further contemplated that strands of the twisted yarn 100 can also be woven with non-twisted strands to form woven material for forming portions of the article. Thus, it is to be understood, that various constructions of polymer filaments may be woven to form the woven material having various aesthetic appearances.

Although in accordance with the preferred embodiment, the woven material is formed in situ on the frame, it is contemplated that panels of pre-woven material may be adhered to the frame and subsequently heat set by placing the article of furniture in an oven as thus far described. It is therefore contemplated that portions of the article of furniture may be formed with woven material in situ, other portions by attaching panels of pre-woven material thereto, as well as variations thereof. In any event, the article of furniture will be placed in an oven to heat set the woven material and any wrapped portions of the article with the polymer strands of twisted or non-twisted strands.

The present invention has thus far been described by heating at least one of the elongated strands 102, 104 of polymer material to about its softening temperature whereby the strands upon twisting adhere to one another to prevent their unraveling. The twisting process may occur either before or after the heating process. The heating may take place either in an oven 110 or as a result of the strands 102, 104 being formed by hot extrusion of the polymer material through a die. In either case, at least one of the strands 102, 104 has been heated to approximately its softening temperature for adhering to the other strand upon cooling.

It is generally known that polymer materials can possess shape memory characteristics. This shape retention characteristic is dependent upon the nature and temperature of the polymer material. It is contemplated that this property can be utilized to form a twisted polymer yarn without the need of heating at least one strand to about its softening temperature whereby the strands will adhere to each other. By way of example, by heating at least one, and preferably both of the strands 102, 104, to a temperature of between 100°–200° F. prior to twisting, the heated strands upon cooling will essentially maintain their twisted configuration.

It is contemplated that the slight heating of at least one strand will allow the strand to relax so as to twist with an additional strand, and retain its twisted shape upon cooling. The heating will provide the strand with a sufficient heat set to retain its shape. In accordance with this embodiment, it is not a requirement of the present invention that the strands 102, 104 be adhered to each other along a portion of their length such as by heating at least one of the strands to its softening temperature or above where the two strands are integrally bonded or joined together. The heat setting of the twisted yarn in accordance with this embodiment will be sufficient to prevent the strands 102, 104 from unraveling during the weaving process. However, the two strands 102, 104 can be stripped from each other by opening the twist and separating the two strands if desired. This is generally considered not possible when the strands are adhered to each other in accordance with the prior embodiment.

The strands 102, 104 may be heated prior to or after the twisting operation. In addition, the strands 102, 104 may be heated in one or more ovens to the same or different temperatures. In addition, the strands 102, 104 may be heated as a result of their hot extrusion from an extrusion die during their formation thereby eliminating the need for an oven.

Although the invention herein has been described with reference to particular embodiments, it is to be understood that these embodiments are merely illustrative of the principles and application of the present invention. It is therefore to be understood that numerous modifications may be made to the illustrative embodiments and that other arrangements may be devised without departing from the spirit and scope of the present invention as defined by the appended claims.

The invention claimed is:

1. An article of furniture comprising a frame having a shape of an article of furniture and at least one panel attached thereto formed as a weave from a plurality of elongated members of polymer material, said panel forming an occupant supporting portion, said plurality of elongated members at least including an elongated first yarn twisted together with an elongated second yarn forming a composite yarn having a twisted shape, wherein each of said plurality of elongated members at least includes an outer layer formed from the same polymer material, and wherein one of said first and second yarns is different from the other one of said first and second yarns in at least one of shape, surface configuration and surface appearance.

2. The article of claim 1, further including an elongated third yarn of said polymer material twisted together with said first and second yarns.

3. The article of claim 2, wherein said third yarn is substantially similar to one of said first and second yarns in at least one of size, shape, surface, configuration and surface appearance.

4. The article of claim 2, wherein said third yarn is different from said first and second yarns in at least one of size, shape, surface configuration and surface appearance.

5. The article of claim 2, wherein said third yarn is similar to one of said first and second yarns in size, shape, surface configuration and surface appearance.

6. The article of claim 2, wherein said third yarn is different from said first and second yarns in size, shape, surface configuration and surface appearance.

7. The article of claim 1, wherein said one of said first and second yarns is different from the other one of said first and second yarns in size, shape, surface configuration and surface appearance.

8. The article of claim 1, wherein said surface appearance comprise coloration.

9. An article of furniture comprising a frame having a shape of an article of furniture and at least one panel attached thereto formed as a weave from a plurality of elongated members of polymer material, said panel forming an occupant supporting portion, said plurality of elongated members at least including an elongated first yarn, an elongated second yarn and an elongated third yarn, said first, second and third yarns twisted together to form a composite twisted yarn, wherein each of said plurality of elongated members at least includes an outer layer formed from the same polymer material, and wherein one of said first, second and third yarns is different from at least one of the other two yarns in at least one of shape, surface configuration and surface appearance, wherein each of said first, second and third yarns include a longitudinally extending core of a polymer material.

10. The article of claim 9, wherein said surface appearance comprises coloration.

11. The article of claim 9, wherein each of said first, second and third yarns are different from each other in at least one of size, shape, surface configuration and surface appearance.

12. The article of claim 9, wherein each of said first, second and third yarns are different from each other in size, shape, surface configuration and surface appearance.

13. The article of claim 1, wherein at least one of said plurality of elongated members includes an inner core of polymer material.

14. The article of claim 9, wherein at least one of said plurality of elongated members includes an inner core of polymer material.

15. The article of claim 1, wherein said first and second yarns are the same length in said composite yarn.

16. The article of claim 9, wherein said first and second yarns are the same length in said composite twisted yarn.

* * * * *